United States Patent [19]

Kawahito et al.

[11] Patent Number: 4,859,537

[45] Date of Patent: Aug. 22, 1989

[54] THERMAL TRANSFER RECORDING MEDIUM

[75] Inventors: Shiro Kawahito, Utsunomiya; Masanori Minato, Ichikaimachi, both of Japan

[73] Assignee: Kao Corporation, Tokyo, Japan

[21] Appl. No.: 226,316

[22] Filed: Jul. 27, 1988

[30] Foreign Application Priority Data

Jul. 28, 1987 [JP] Japan ..... 62-187923

[51] Int. Cl.[4] ..... B41M 5/26

[52] U.S. Cl. ..... 428/411.1; 428/195; 428/330; 428/484; 428/488.1; 428/702; 428/913; 428/914

[58] Field of Search ..... 428/195, 411.1, 484, 428/488.1, 488.4, 913, 914, 702, 330; 503/208, 209

[56] References Cited

U.S. PATENT DOCUMENTS 4,295,888 10/1981 Greenwood et al. ..... 503/209

*Primary Examiner*—Ellis P. Robinson
*Assistant Examiner*—P. R. Schwartz

[57] ABSTRACT

A thermal transfer recording medium comprises a substrate and a layer of a hot-melting ink composition, coated on the substrate, comprising a hot-melting binder, a coloring matter and 0.1 to 5 percent by weight, based on the composition as the solid content, of an alkaline earth metal phenate.

2 Claims, 1 Drawing Sheet

THERMAL TRANSFER RECORDING MEDIUM

The present invention relates to a thermal transfer recording medium, and more particularly to a thermal transfer recording medium which has excellent productivity and gives a transferred image having a high optical reflection density.

[Prior Art]

Thermal transfer recording is a recording method in which a thermal transfer recording medium composed of a sheet substrate coated with at least one hot-melting ink layer is used, said thermal transfer recording medium being superimposed upon recording paper in such a manner that the hot-melting ink layer is brought into contact with the recording paper, said ink layer being melted by heating it from the substrate side of the recording medium with a thermal head, thereby giving a transferred image on the recording paper.

According to this method, apparatuses used generate not so much noise and are excellent in operability and maintenance and plain paper can be used as the recording paper so that said method has been widely used in recent years.

Conventional thermal transfer ink is obtained by dispersing a colorant in a binder mainly composed of wax. The thermal transfer ink is applied to a substrate by hot melt coating to obtain a thermal transfer recording medium.

However, the thermal transfer recording medium obtained by using the binder mainly composed of wax has disadvantages that (a) the print is brittle and poor in fastness, (b) the resolution of the print is poor, that is, the print blurs, (c) required printing energy is so high that the speedup of printing is difficult, (d) repeated printing is impossible, etc.

Accordingly, an ink binder has been gradually switched over from that mainly composed of wax to that mainly composed of resin such as polyester resin, polyamide resin, styrene resin or styrene/acrylic resin to thereby provide a thermal transfer recording medium which is free from the above-described problems and can meet various needs.

However, when the resin is used as a binder, the melt viscosity of the ink is so high that there is much difficulty in conducting hot-melt coating which has been conventionally carried out.

Thus, an available coating fluid is necessarily a solvent-based ink prepared by dissolving or dispersing components such as a binder and a colorant in an organic solvent such as toluene, isopropyl alcohol or methyl ethyl ketone.

However, the solvent-based ink has difficulty in dispersing the colorant therein. Thus, when the dispersion time is short, a thermal transfer recording medium obtained by using this ink gives a transferred image which does not exhibit a satisfactory optical reflection density. When the dispersion time is prolonged, the problem can be solved. However, it cannot be considered to be fully satisfying in this regard as yet and it inevitably causes lowering in productivity.

As described above, the dispersibility of a colorant in a solvent-based ink for a thermal transfer recording medium causes some problems. There has been found no technique which allows a colorant to be easily dispersed in an ink, and gives a thermal transfer recording medium which gives a transferred image having a high optical reflection density and a print of good quality and is of guaranteed quality.

(Summary of the Invention)

The invention has been performed with a view to eliminate the above-mentioned drawbacks. It is an object of the present invention to provide a thermal recording medium which allows a colorant to be well dispersed in an ink during the course of the production thereof, does not cause blocking during storage and gives a print of good quality and a transferred image having an excellent optical reflection density.

The present inventors have made intensive studies to attain the above object and have found that when a hot-melting ink containing 0.1 to 5% by weight (based on the amount of the ink on a solid basis) of an alkaline earth metal phenate as a dispersant for the colorant is used, there can be obtained an excellent thermal transfer recording medium meeting the above-mentioned requirements. The present invention is based on this finding.

Accordingly, the present invention provides a thermal transfer recording medium obtained by applying a hot-melting ink to a substrate, characterized in that the hot-melting ink contains 0.1 to 5% by weight of an alkaline earth metal phenate based on the amount (on a solid basis) of the ink.

The thermal transfer recording medium comprises a substrate and a layer of a hot-melting ink composition, coated on the substrate, comprising a hot-melting binder, a coloring matter and 0.1 to 5 percent by weight, based on the composition as the solid content, of an alkaline earth metal phenate.

The alkaline earth metal is preferred to be magnesium, calcium or barium and the phenate is preferred to be a neutral salt of the phenate or a super basic phenate.

The term "alkaline earth metal phenate" as used herein refers to an alkaline earth metal salt of an alkylphenol having the following formula (I) or (II):

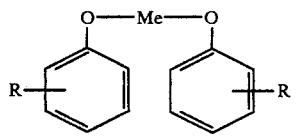

(I)

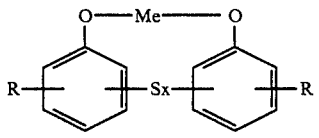

(II)

wherein R is an alkyl group having 1 to 40 carbon atoms, x is a number of 1 to 2, and Me is an alkaline earth metal. The alkylphenol can be synthesized, for example, by alkylating benzene in the presence of a Friedel-Crafts catalyst by using wax, an alcohol or an olefin obtained by the low polymerization of propylene.

The alkaline earth metal phenate can be generally synthesized by reacting an alkylphenol with elementary sulfur and an alkaline earth metal hydroxide in an alcoholic solvent such as methanol, ethanol or ethylene glycol at a temperature of room temperature to 200° C.

Examples of the alkaline earth metal which can be used in the present invention include magnesium, calcium and barium.

The alkaline earth metal phenate which can be used in the present invention include neutral salts (normal salts) represented by the formulas (I) and (II) as well as basic phenates obtained by heating a phenate with an excess amount of an alkaline earth metal compound in the presence of water, and so-called super basic phenates obtained by reacting a phenate with an alkaline earth metal oxide or hydroxide in the presence of carbon dioxide gas.

However, the production of the alkaline earth metal phenate of the present invention is not limited to the methods described above.

The thermal transfer recording medium of the present invention contains 0.1 to 5% by weight of the alkaline earth metal phenate based on the amount (on a solid basis) of the hot-melting ink. When the content of the phenate is lower than 0.1% by weight, an effect of dispersing a colorant is insufficient and a thermal transfer recording medium capable of exhibiting the desired effect cannot be obtained, while when the content is higher than 5% by weight, there are other disadvantages in effects. Particularly, when the content is 10% by weight or higher, blocking is liable to be caused.

Examples of the substrate for the thermal transfer recording medium of the present invention include paper such as capacitor paper and glassine paper, and films such as polyester, polycarbonate, polyimide, polyamide, polyethylene and polypropylene films. The thickness of the substrate is in the range of preferably about 2 to 20 μm.

In order to prevent sticking, a heat-resistant protective layer composed of a heat-resistant resin may be provided on the opposite side to the ink composition layer.

The hot-melting ink layer of the present invention can be formed by using a hot-melting binder and a colorant as principal ingredients and adding the alkaline earth metal phenate thereto. Examples of the hot-melting binder include polystyrene, polyacrylic acid, polyacrylic ester, styrene/acrylic acid copolymer, styrene/acrylic ester copolymer, polymethacrylic ester, polyacrylamide, polyvinyl ester, unsaturated polyester, polyvinyl chloride, ketone resin, terpene resin, hydrogenated terpene resin, cumarone resin, rosin ester, rosin-modified resin and maleic acid resin. These resins may be used either alone or as a mixture of two or more of them.

In addition to the above-described resins, other examples of the hot-melting, binder which can be used in the present invention include waxes such as paraffin wax, microcrystalline wax, polyethylene wax, carnauba wax, candellilla wax, rice wax, montan wax, beeswax, lanolin, oxidized paraffin wax, oxidized microcrystalline wax and oxidized polyethylene wax; higher fatty acids, and metal salts and esters thereof, such as stearic acid, lauric acid, palmitic acid, lead stearate, barium stearate, zinc stearate and stearyl stearate; and resins such as polyethylene, polypropylene, ethylene/vinyl acetate copolymer and saturated polyester.

Examples of the colorant which can be incorporated in the hot-melting ink layer of the present invention include organic and inorganic pigments which are conventionally used, such as carbon black.

If desired, conventional additives such as silicone oil and mineral oil may be added to the hot-melting ink layer of the present invention.

In applying the hot-melting ink of the present invention, the desired effect can be obtained by using the alkaline earth metal phenate, not only when an ink obtained by directly dissolving or dispersing the resin and the colorant in a solvent is used, but also when a resin ink obtained by hot-melt-dispersing a resin is dissolved in a solvent and then applied or when hot-melt-coating is directly carried out.

By constituting the invention in the above-described manner, there can be obtained a thermal transfer recording medium which has excellent producibility, given a print having an excellent optical reflectance density and is freed from the problem of blocking during storage.

Figure 1:
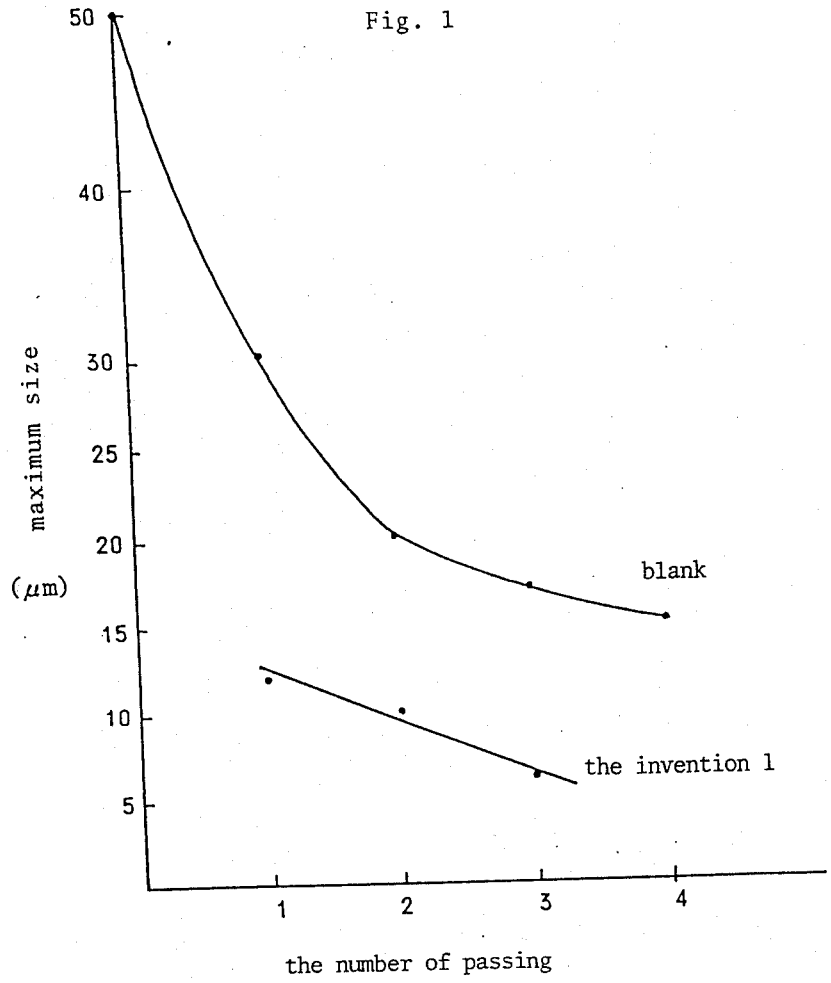
FIG. 1 is a graph showing the relationship between the sample 1 of the invention and the blank with respect to the number of repetitions of passage and the maximum particle size of carbon black.

Parts given in the Examples are by weight unless otherwise stated.

EXAMPLE 1

A solvent-based thermal transfer ink having the following compositions, mainly composed a polyester resin having a softening point of 90° C. and a melt viscosity of 23000 cps. at 120° C. were prepared. In preparing the ink, various additives listed in Table 1 were used. The mixture was milled in a ball mill for 15 hr to obtain an ink-forming coating fluid.

<Composition of thermal transfer ink>

| Ingredients | Amount |
|---|---|
| polyester resin | 18 parts |
| carnauba wax | 7.5 parts |
| carbon black | 4.5 parts |
| toluene | 35 parts |
| methyl ethyl ketone | 18 parts |
| isopropyl alcohol | 17 parts |
| additives listed in Table 1 | amounts given in Table 1 |

Additives used in comparative samples were chosen by the following reasons.

The dimer acid polyamide resin and the ethylene/vinyl acetate copolymer resin are known to be excellent dispersants for colorants. The sodium dialkyl sulfosuccinate is a nonaqueous surfactant and is expected to be effective in dispersing colorants.

The coating fluid was applied to a polyethylene terephthalate (PET) film of 6 μm by using a wire bar #4 and dried to obtain a thermal transfer recording medium having a hot-melting ink layer of 1.5 g/m$^2$ (dry).

The thermal transfer recording medium was examined with an optical microscope to measure the maximum particle size of carbon black. A reflection density (hereinafter referred to as OD) was measured with a Macbeth reflection densitometer RD 918. The results are shown in Table 1.

TABLE 1

| Additive | Amount (%) based on ink (on a solid basis) | Max. diameter of carbon black (μm) | OD |
|---|---|---|---|
| (this invention) | | | |
| Sample 1*1 | 1.0 | 10 | 1.53 |
| Sample 2*2 | 1.0 | 8 | 1.54 |
| (comparative) | | | |
| Pelex OTP*3 | 1.0 | 30 | 1.30 |
| Evaflex EV40X*4 | 1.5 | 30 | 1.30 |

TABLE 1-continued

| Additive | Amount (%) based on ink (on a solid basis) | Max. diameter of carbon black (μm) | OD |
|---|---|---|---|
| Rheomide S-2400*5 | 5 | 25 | 1.30 |
| " | 10 | 30 | 1.25 |
| Blank | — | 25 | 1.30 |

Note:
*1Sample 1: alkaline earth metal phenate sulfide, dark brown viscous liquid, specific gravity: 0.98 elemental analysis: Ca 4.5 wt. %, S 3.1 wt. % alkalinity: 126
*2Sample 2: superbasic alkaline earth metal phenate sulfide, dark brown viscous liquid, specific gravity: 1.98 elemental analysis: Ca 9.3 wt. %, S 3.0 wt. %, kinematic viscosity: 90 cst at 100° C.
*3Pelex OTP: a product of Kao Corp., sodium dialkyl sulfosucinate
*4Evaflex EV40X: a product of Mitsui du Pont Chemical, ethylene/vinyl acetate copolymer
*5Rheomide S-2400: a product of Kao Corp., dimer acid polyamide resin

EXAMPLE 2

The sample 2 used in Example 1 was used as the additive and the solvent-based thermal transfer ink having the same composition ratio as that of Example 1 was prepared by varying the amount of the sample 2 as shown in Table 2. The mixture was milled in a sand mill to obtain an ink layer-forming coating fluid.

The maximum particle size of carbon black containing 3% of the sample 2 was measured each time it had passed through the sand mill. The results are shown in FIG. 1.

The coating fluid containing no sample 2 was evaluated as blank. The results are shown in FIG. 1.

The viscosity of the resulting ink layer-forming coating fluid was measured with a Brookfield viscometer. The results are shown in Table 2.

A polyethylene terephthalate film of 6 μm in thickness was previously coated with paraffin by a conventional method in such an amount as to give a dry film of 1 μm in thickness. The coating fluid was then applied to the film by using a wire bar to provide an ink layer of 3.5 μm in dry thickness, thus obtaining a thermal transfer recording medium.

The thermal transfer recording medium was cut into samples. Printing was conducted on thermal transfer paper (BEKK 300 sec) by using a label printer K464E manufactured by Anritsu K.K. to evaluate the quality of the print. Further, two sheets of the thermal transfer recording medium were superimposed upon each other (whereby the ink layer was brought into close contact with the rear side of the substrate). A pressure of 10 g/cm$^2$ was applied thereto in a thermostat at 60° C., and they were left to stand for 15 hr. Subsequently, the degree of blocking was evaluated. Further, the OD and the maximum particle size were measured in a similar manner to that described in Example 1. The results are shown in Table 2.

TABLE 2

| | Comp. sample | Sample of the invention | | Comp. sample | |
|---|---|---|---|---|---|
| | 1 | 1 | 2 | 2 | Blank |
| Amount (wt. %) of sample 2 based on ink (on a solid basis) | 10 | 3.0 | 1.0 | 0.05 | 0 |
| No. of repetitions of passage through a sand mill | 3 | 3 | 3 | 3 | 4 |
| Brookfield viscosity (cps) | 290 | 230 | 183 | 155 | 175 |
| Max. particle size (μm) | 6 | 6 | 8 | 15 | 15 |
| OD | 1.35 | 1.48 | 1.46 | 1.38 | 1.35 |
| Evaluation of print*1 | Δ | | | | |
| Blocking test*2 | X | | | | |

Note:
*1Evaluation of print
good
Δ partially bad
X bad
*2Blocking test
No blocking occurred.
Δ Part of the ink layer taken up by the rear side of the substrate.
X Most of the ink layer taken up by the rear side of the substrate.

We claim:

1. A thermal transfer recording medium which comprises a substrate and a layer of a hot-melting ink composition, coated on the substrate, comprising a hot-melting binder, a coloring matter and 0.1 to 5 percent by weight, based on the composition as the solid content, of an alkaline earth metal phenate.

2. A medium as claimed in claim 1, in which the alkaline earth metal is magnesium, calcium or barium and the phenate is a neutral salt of the phenate or a super basic phenate.

* * * * *